US006409418B1

(12) United States Patent
Blair et al.

(10) Patent No.: US 6,409,418 B1
(45) Date of Patent: Jun. 25, 2002

(54) TIRE DEFLATING BLADE SYSTEM

(75) Inventors: William H. Blair, Wheeling; David R. Blair, Triadelphia; Robert E. Steele, Wheeling, all of WV (US)

(73) Assignee: PMG, Inc., Wheeling, WV (US)

( * ) Notice: Subject to any disclaimer, the term of this patent is extended or adjusted under 35 U.S.C. 154(b) by 0 days.

(21) Appl. No.: 09/563,320

(22) Filed: May 3, 2000

Related U.S. Application Data

(60) Provisional application No. 60/132,208, filed on May 3, 1999.

(51) Int. Cl.[7] ..... E01F 13/12
(52) U.S. Cl. ..... 404/6
(58) Field of Search ..... 404/6; 256/1; 40/612; 116/63 R, 63 P; 30/351, 353, 501, 502

(56) References Cited

U.S. PATENT DOCUMENTS

| | | | | | |
|---|---|---|---|---|---|
| 75,255 | A | * | 3/1868 | Fenton | 30/353 |
| 334,724 | A | * | 1/1886 | Ruekstuhl | 30/353 |
| 924,403 | A | * | 6/1909 | Utt | 256/1 |
| 1,094,226 | A | * | 4/1914 | Le Duc | 256/1 |
| 1,276,100 | A | | 8/1918 | Niznik | |
| 2,313,388 | A | * | 3/1943 | McDonald | 256/1 |
| 2,762,145 | A | * | 9/1956 | Rupe | 256/1 |
| 2,912,229 | A | | 11/1959 | Persgard | |
| 3,570,376 | A | * | 3/1971 | Overton, III et al. | 116/63 P |
| 4,050,401 | A | * | 9/1977 | Kelly | 116/63 P |
| 4,318,079 | A | * | 3/1982 | Dickinson | 404/6 |
| 4,382,714 | A | | 5/1983 | Hutchinson | 404/6 |
| 4,995,756 | A | | 2/1991 | Kilgrow et al. | 404/6 |
| 5,123,774 | A | | 6/1992 | Dubiel | 404/6 |
| 5,253,950 | A | | 10/1993 | Kilgrow et al. | 404/6 |
| 5,288,164 | A | * | 2/1994 | Nasatka | 404/10 |
| 5,322,385 | A | | 6/1994 | Reisman | 404/6 |
| 5,330,285 | A | | 7/1994 | Greves et al. | 404/6 |
| 5,414,931 | A | * | 5/1995 | Wollermann | 30/90.1 |
| 5,498,102 | A | * | 3/1996 | Bissell | 404/6 |
| 5,507,588 | A | | 4/1996 | Marts et al. | 404/6 |
| RE35,373 | E | | 11/1996 | Kilgrow et al. | 404/6 |
| 5,588,774 | A | * | 12/1996 | Behan | 404/6 |
| 5,733,063 | A | * | 3/1998 | Bailey et al. | 404/6 |
| 5,820,293 | A | | 10/1998 | Groen et al. | 404/6 |
| 5,890,832 | A | * | 4/1999 | Soleau | 404/6 |
| 5,921,703 | A | * | 7/1999 | Becker et al. | 404/6 |
| 5,997,211 | A | * | 12/1999 | Chou | 404/6 |
| 6,155,745 | A | * | 12/2000 | Groen et al. | 404/6 |

FOREIGN PATENT DOCUMENTS

| | | | | |
|---|---|---|---|---|
| DE | 195 09 404 | * | 8/1996 | |
| FR | 2 603 921 | * | 3/1988 | E10F/13/00 |
| GB | 2032983 | | 10/1978 | E01F/13/00 |

OTHER PUBLICATIONS

Photocopy of current brochure for "Safe Stop Magnum Spike System," by Phoenix International Ltd. V.

* cited by examiner

*Primary Examiner*—Gary Scott Hartmann
(74) *Attorney, Agent, or Firm*—Steptoe & Johnson PLLC

(57) ABSTRACT

A tire deflating blade system is disclosed having a plurality of tire deflating blade system modules that can be adjacently and pivotally connected together to form a tire deflating blade system of variable length. Each tire deflating blade system module comprises a base being generally rectangular in shape and having an end profile that is generally trapezoidal in shape. One or more blades are permanently disposed in the base and are rotatably connected to a shaft that runs longitudinally through the base, such that the blades can be moved between a retracted position for storage and an armed position for deflating tires upon the longitudinal movement of the shaft. The blades are very strong having a plurality of sharpened edges and at least two points. A cover plate is positioned over each blade to ensure safety while handling and storing the device while the blades are in the retracted position, thereby preventing anyone and any thing from being cut by the blades. In addition, a means for warning oncoming traffic is incorporated in the tire deflating blade system module, such as a barber pole, that is also rotated between an upright and retracted position upon the longitudinal movement of the shaft.

20 Claims, 26 Drawing Sheets

400

800

900

1200

1100

1000

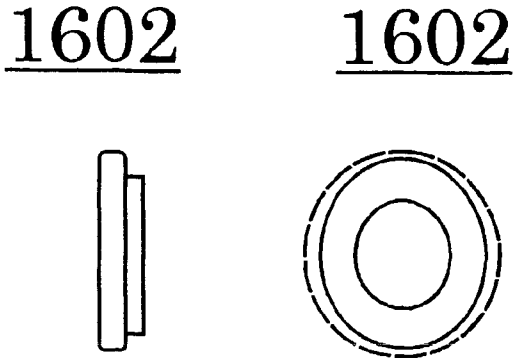
FIG. 16A
FIG. 16B
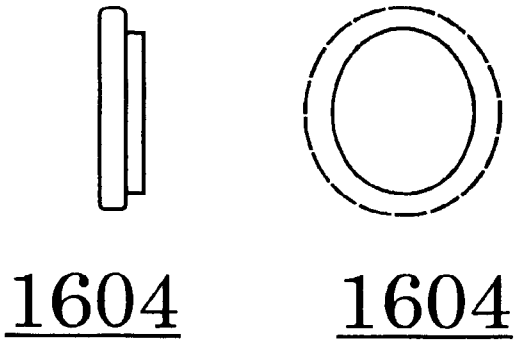
FIG. 16C
FIG. 16D

TIRE DEFLATING BLADE SYSTEM

CROSS REFERENCE TO RELATED APPLICATIONS

This application claims the benefit of Application No.60/132,208 filed May 3, 1999.

BACKGROUND OF THE INVENTION

1. Field of the Invention

This invention relates to apparatuses for deflating the tires of a vehicle, and specifically, to an apparatus having a plurality of permanent blades rotatably disposed within a base for immediately destroying a tire of a vehicle upon engagement.

2. Related Art

Tire deflation devices are well known in the prior art and are available in many different shapes and sizes. These devices typically comprise some type of support base containing a plurality of hollow spikes. The base is placed on a road surface so that a passing vehicle runs over the device and the spikes are removed from the base and puncture one or more tires, thereby allowing air to escape the tire and stopping the vehicle.

One problem shared by most of the conventional tire deflation devices is that these devices are intended to be either entirely or partially disposable. That is, there are tire deflation devices that after a single use, a user simply disposes of the used device or must purchase and install replacement spikes that have been removed from the device by a passing vehicle. Therefore, there is a need for a tire deflation device that does not have to be either entirely replaced nor requires replacement spikes after a single use.

In addition to the above limitation, most conventional tire deflation devices are large and cumbersome wherein the support base typically has a length designed to cover a significant portion, e.g., a lane of traffic, of a road surface. In certain instances, a conventional tire deflation device may be shorter than the length of a lane of traffic, but still designed to be longer than a width of a single tire. None of these conventional devices, however, can be adjusted in terms of their length to provide a variable length tire deflation device. Therefore, there is a need for a tire deflation device, that is modular wherein multiple modules can be connected to create a tire deflation device of any variable length, thereby covering any desire length of road surface.

As yet another disadvantage to conventional tire deflation devices, these devices use hollow spikes as the means for deflating a vehicle's tires. As the vehicle passes over the device, a front tire of a vehicle engages one or more spikes, removes the spikes from the device, and as the vehicle travels away from the device, the air in the front tire slowly escapes, thereby bringing the vehicle to a controlled stop.

There are several problems with using removable hollow spikes in a tire deflation device. First, vehicles engaging these conventional tire deflation devices can travel for long distances past the device before stopping. This is because the air escapes the tire(s) slowly resulting in a controlled deflation of the tire(s). As a result, law enforcement personnel using such a conventional tire deflation device must continue to pursue the vehicle which may result in other unforeseen problems, e.g., abandoned cars, continuation of unsafe high speed chases, and an increased risk of accidents.

Second, the spikes are intended to be removed from the device upon impact with a tire such that the removed spikes must be replaced with new spikes and the device is rendered virtually unusable until the removed spikes are replaced with new spikes. Also, there are often instances where some spikes are not removed by the vehicle, but are damaged nonetheless, e.g., bent, broken, etc., thereby still requiring their replacement before the device is usable against another vehicle. In alternative conventional devices, the entire device is intended to be disposable wherein after a single use the device must be disposed of.

Third, if the spikes are not removable from the device, then the spikes must be strong enough to withstand the stresses of a tire engaging and then disengaging from the spikes. Once disengaged, the spike will leave a hole in the tire. However, because the tire is made of rubber, the resulting hole may be partially or completely closed off due to the elastic properties of the tire rubber. Therefore, once again the vehicle does not come to an immediate stop, but rather may travel for a distance before stopping and increasing the opportunity for further damage and injury.

Fourth, and most importantly, these conventional tire deflating devices only disable the front tires of a passing vehicle. This is because when the front tires of a vehicle engage the device, the front tires remove the spikes. Therefore, when the rear tires engage the device, there are no spikes to engage the rear tires because the rear tires often follow the same path as the front tires. As a result, the conventional tire deflating devices are only effective in engaging the front tires of a vehicle.

Therefore, there is a need for a tire deflation device that stops a vehicle immediately upon engaging the tire deflation device. There is a further need for a tire deflation device that does not require replacement parts, e.g., spikes, every time the device is used to stop a vehicle. There is still a further need for a tire deflation device that engages and renderes useless both the front and rear tires of a passing vehicle.

Lastly, conventional tire deflation devices do not incorporate any means for warning oncoming traffic as to the existence or location of the tire deflation device. If law enforcement personnel wants to warn oncoming traffic of the device, a separate warning device, e.g., a sign, flag, or flagman, must be employed. Therefore, the law enforcement personnel must manage multiple devices or means for warning which is very awkward and cumbersome.

Therefore, there is a need for a tire deflation device that incorporates a means for warning oncoming traffic as to the existence and location of the tire deflation device.

SUMMARY OF THE INVENTION

The present invention solves the problems associated with conventional tire deflation devices by providing a tire deflating blade system designed to be deployed and retracted by a single individual. The tire deflating blade system comprises a plurality of tire deflating blade system modules that can be adjacently and pivotally connected together to form a tire deflating blade system of variable length. When not in use, the tire deflating blade system modules of the present invention are housed in a storage container.

Each tire deflating blade system module comprises a base being generally rectangular in shape and having an end profile that is generally trapezoidal in shape. One or more blades are permanently disposed in the base and are rotatably connected to a shaft that runs longitudinally through the base, such that the blades can be moved between a retracted position for storage and an armed position for deflating tires. The blades are very strong having a plurality of sharpened edges and at least two sharp points. In addition, an optional cover plate is positioned over each blade to ensure safety while handling and storing the device while the blades are in the retracted position, thereby preventing anyone and any thing from being cut by the blades.

A tire deflating blade system module of the present invention also incorporates a means for engaging the blades into these two positions. Possible means include a mechanical switch, an electronic switch, or hydraulic or remote means. The preferred embodiment comprises a mechanical switch, e.g. a lever, connected to the tire deflating blade system module, such that with a pull of a lever, the blades are put in an armed position and with a push of the lever, the blades return to a retracted position.

In storage, the modules of a tire deflating blade system of the present invention are stacked up and stored in a storage container wherein the blades are in a retracted position. A user deploys the tire deflating blade system by placing the modules across one or more lanes of traffic as needed. The user can deploy and interconnect two or more modules depending on the needed coverage. Also, the modules are interconnected to allow the user to raise and lower all of the blades of all of the deployed modules in unison. When the appropriate time is at hand, the user engages the blades and raises them into an armed position. When a vehicle runs over the tire deflating blade system, the blades cut through the tires bringing the vehicle to an immediate stop. Once coverage is no longer required, the operator disengages the blades and lowers them into the retracted position. Then, the operator can disconnect the modules and place them in a storage container for later use.

The tire deflating blade system can either be left on, or in, the road or other covered surface with the blades in the retracted position, allowing for use at another time. The modules of the tire deflating blade system can be detached from each other, removed, stacked up, and stored until needed again. In an alternative embodiment, the tire deflating blade system can be permanently disposed in a road to provide a permanent means for controlling undesired vehicle movement. In the preferred embodiment, the tire deflating blade system is used as a permanent, or semi-permanent, system within a roadway, wherein it is seldom, if ever, moved once it is deployed.

There are many advantages associated with the tire deflating blade system of the present invention. First, a tire deflating blade system of the present invention can be transported, deployed and retracted by a single person. Due to the ability of the blades to retract, multiple modules can be stacked within a storage container. When needed, a person can transport the storage container to the required location, deploy the modules, and connect the needed number of modules to cover a specific traffic area, thereby creating a tire deflating blade system of variable length. Then, once the tire deflating blade system is no longer needed, the modules can be disconnected and stacked up in the storage container.

Second, unlike conventional tire deflation devices that use spikes, the blades of the tire deflating blade system are permanently disposed in the base of a module and can withstand repeated use. Therefore, when a vehicle runs over the tire deflating blade system, the blades are not removed from the base, but rather remain in the base. In addition, because the blades are larger and stronger than conventional hollow spikes, the blades can withstand larger stresses imposed by a passing vehicle and will not break, bend, or otherwise become unuseable. Therefore, the tire deflating blade system is completely reusable with no down time between passing vehicles.

Third, the use of larger and strong blades also results in the immediate destruction of a tire by tearing or slicing it in multiple places, thereby bringing a passing vehicle to an immediate stop. This immediate impact is beneficial in that law enforcement personnel will not have to continue a high speed chase, but rather can immediately apprehend a suspect vehicle and its occupants. In addition, the blades of the present invention target all tires of a vehicle—both the front and rear tires.

Fourth, the base of the tire deflating blade modules is of such a shape and construction that it remains substantially motionless as a vehicle rolls over the modules, thereby providing an extremely stable system. The tire deflating blade system also retains greater strength and is less susceptible to break because it is so stable. It is this extreme stability that allows the tire deflating blade system of the present invention to be bidirectional in that it functions equally well regardless of which direction a vehicle passes over a module.

Fifth, the blades of a module can be engaged via a mechanical device, an electronic device, or any hydraulic or remote means. Using a remote control device, an operator can be located far away from the module when engaging the blades. This ensures the safety of the operator.

Furthermore, the tire deflating blade system can be either temporarily deployed across a roadway, and when not in use, it can be disconnected and stored. Alternatively, the tire deflating blade system can be permanently embedded within a roadway, wherein the means for engaging/disengaging the shaft can be removably detached from the tire deflating blade system. This ensures that only the authorized personnel engage the blades into an armed position.

The present invention also provides for a means for warning oncoming traffic as to the location and existence of a tire deflating blade system by providing an optional barber pole assembly. In conjunction with the blades being rotated to an armed position, a barber pole incorporating a warning signal, e.g., a stop or warning sign, warning patterns, etc., is rotated into an upright position as a visual indicator to oncoming vehicles. Also, when the blades are rotated into a retracted position, the barber pole is rotated into a retracted position for storage.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

FIG. 16A is a planar side view of a spring washer;

FIG. 16B is a planar top view of the spring washer;

FIG. 16C is a planar side view of the spring washer;

FIG. 16D is a planar bottom view of the spring washer;

DETAILED DESCRIPTION OF THE PREFERRED EMBODIMENTS

Figure 1:
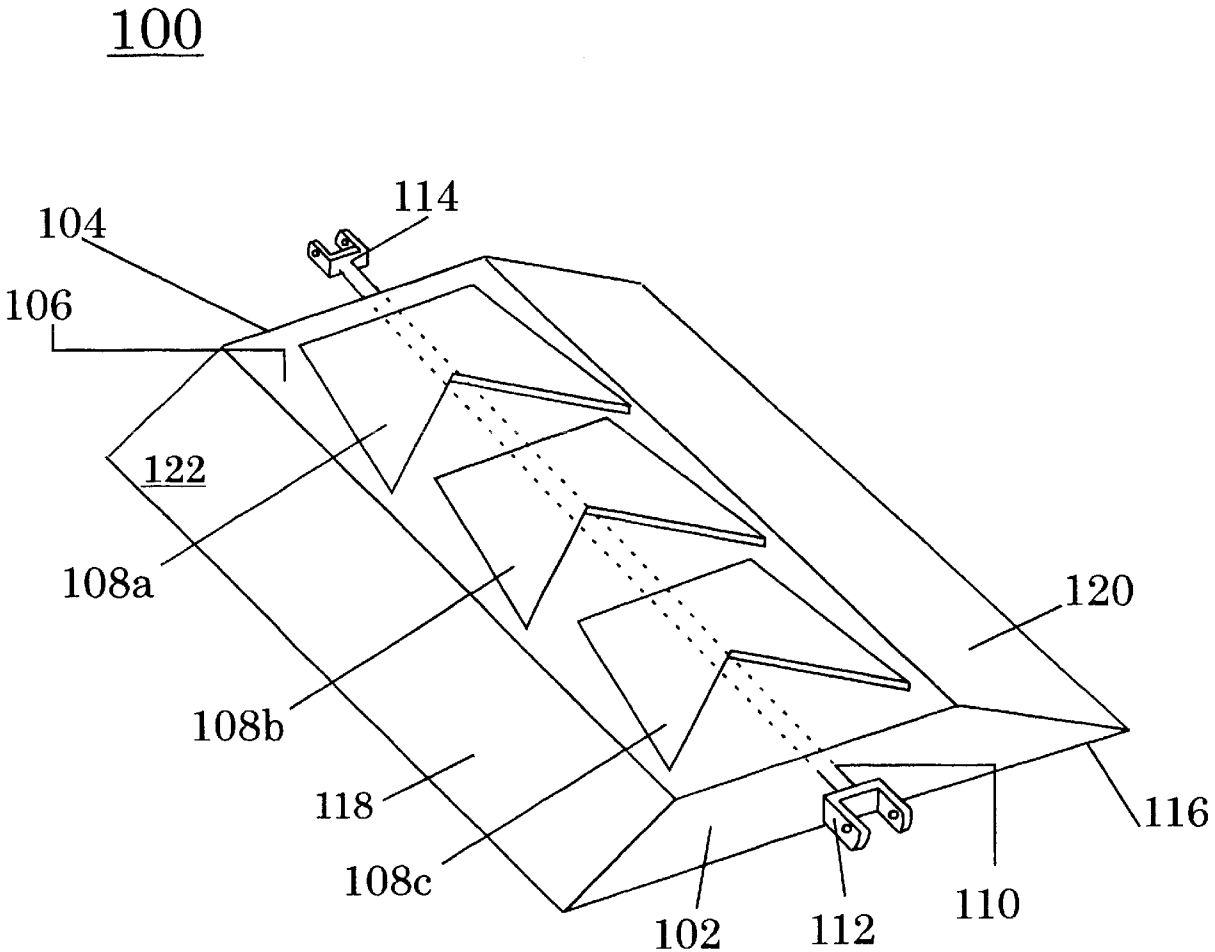
FIG. 1 is a perspective view of a tire deflation blade system module of the present invention with the blades being in a retracted position.
Figure 2:
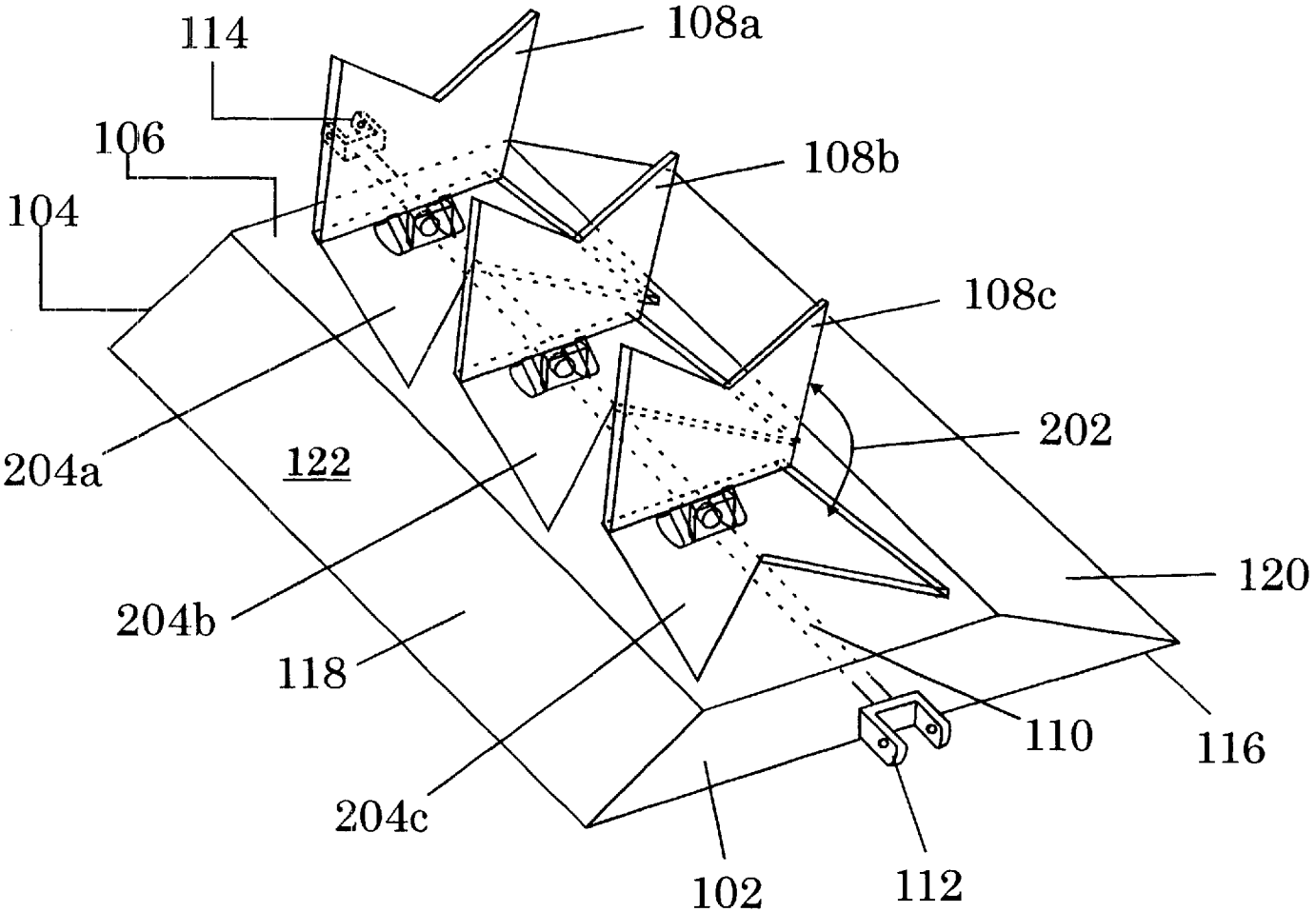
FIG. 2 is a perspective view of a tire deflation blade system module of the present invention with the blades being in an armed position.

FIG. 1 is a perspective view of a tire deflation blade system module (or "module") 100 of the present invention with the blades 108*a–c* in a retracted position, while FIG. 2 shows the module 100 with the blades 108*a–c* in an armed position. In the preferred embodiment, the module 100 has a base 122 that is generally rectangular in shape and has a trapezoidal end profile 102. Specifically, the trapezoidal end profile 102 comprises a bottom 116, a first side 118 having an upwardly sloping angle, a second side 120 having an upwardly sloping angle and a top portion 106 connecting the first side 118 and the second side 120. A plurality of blades 108*a–c* are permanently disposed in the base 122 such that they have a retracted position, as shown in FIG. 1, and an armed position, as shown in FIG. 2. A center shaft 110 is internally disposed in the base 122 interconnecting the blades 108*a–c*. In addition, the preferred embodiment of the base 122 comprises a plurality of apertures 204*a–c* having the shape of the blades 108*a–c* such that when in the retracted position, the blades 108*a–c* are each recessed in an aperture 204*a–c* in the base 122. Further, the apertures 204*a–c* are slightly larger than the size of the blades 108*a–c* in order to accommodate the blade 108*a–c* rotation 202 between an armed and retracted position.

A means for engaging the blades 108*a–c* is connected to the shaft 110 in order to lower the blades 108*a–c* to the retracted position or raise them to the armed position. In the preferred embodiment, the means for engaging the blades 108*a–c* comprises the shaft 110 moving longitudinally within the base 122 such that when the shaft 110 is pulled, the blades 108*a–c* are raised to the armed position, and when the shaft 110 is pushed, the blades 108*a–c* are pulled back down into the retracted position. In addition, the shaft 110 may be moved longitudinally by either mechanical, electronic, hydraulic or remote control means, all of which are well known in the prior art. In the preferred embodiment, a mechanical means, e.g. a lever, communicates with the shaft 110 wherein when activated, the shaft 110 moves longitudinally within the base 106 of the module 100 to move the blades 108*a–c* between the retracted position and the armed position.

Two modules 100 are connected together via a first connector 112 located at one end of the shaft 110 and a second connector 114 located at the second end of the shaft 110. These connectors are used to adjacently and pivotally connect two modules 100, wherein a locking pin, e.g., a commercially available cotter pin, securely fastens the first connector 112 to the second connector 114. In one embodiment, the connectors 112, 114 comprise commercially available universal joints. Universal joints are well known in the relevant art and it would be readily apparent for one of ordinary skill in the relevant art to use such a connector 112, 114. As shown the first connector 112 is a female connector and the second connector 114 is a male connector, such that the female first connector 112 of a first module 100 is secured to the male second connector 114 of a second module 100 by conventional means, e.g. a cotter pin. Any number of modules 100 may be interconnected together to form a tire deflating blade system of a variable length.

In the preferred embodiment, the base 122 of the module 100 is made of a molded cast aluminum housing; however, other materials could be used, e.g. a hard plastic or a hard rubber. The blades 108*a–c* are made of metal for strength and durability and have been sharpened at their tips and internal edges for immediate impact with a vehicle's tires. The notched-V design shown for the blades 108*a–c* is for convenience only. Other blade 108*a–c* designs would be just as effective at deflating a tire immediately upon impact. In addition, the shaft 110 and its first connector 112 and second connector 114 are preferably made of metal, but other durable materials, e.g., hard plastic and rubber, may be used.

The invention is described in these terms for convenience purpose only. It would be readily apparent to one of ordinary skill in the relevant art to design and manufacture a tire blade system module 100 having a comparable shape and of comparable materials that serves the same function.

Figure 3:
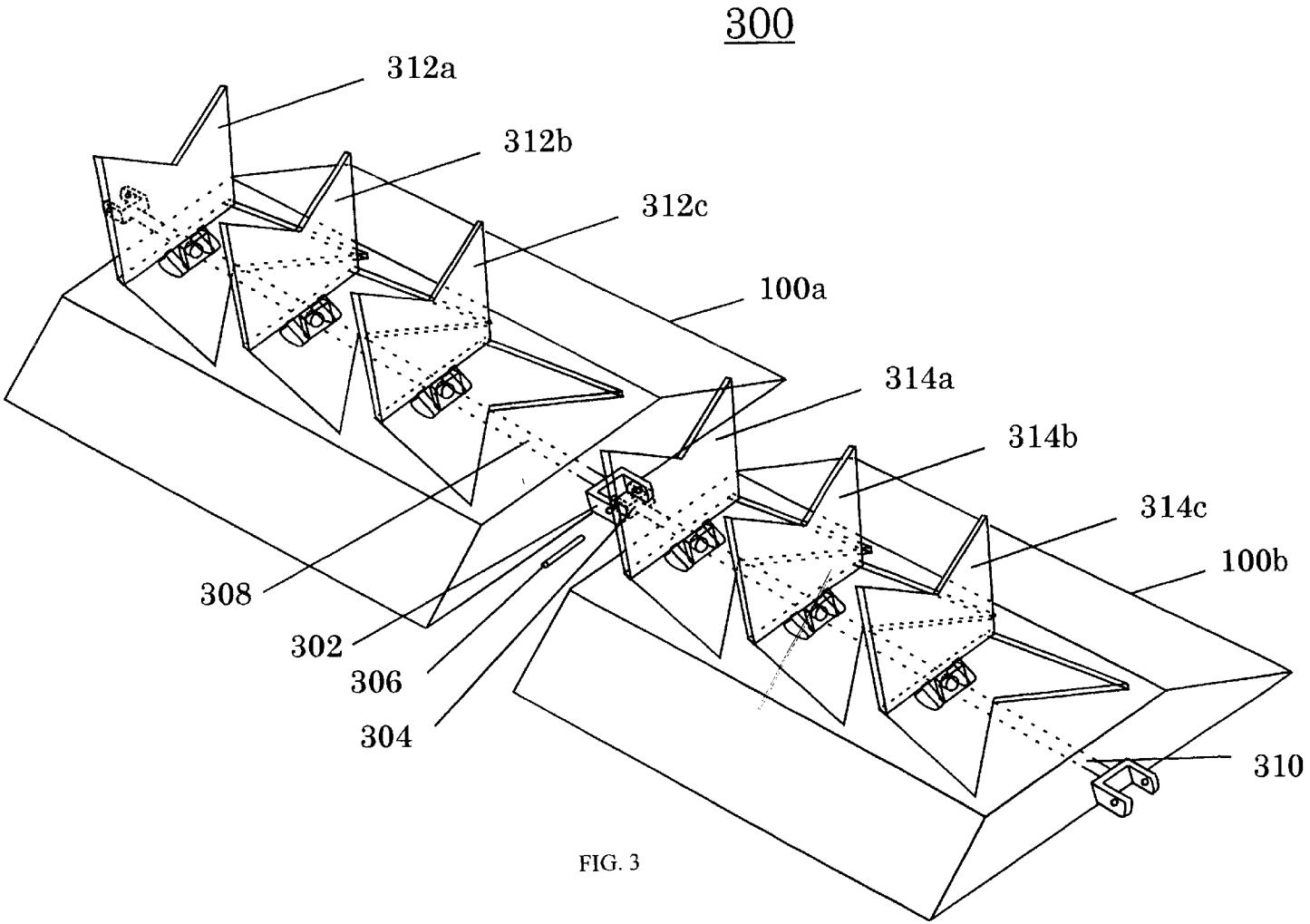
FIG. 3 is a perspective view of two tire deflation blade system modules being adjacently and pivotally connected.

FIG. 3 is a perspective view of two tire deflation blade system modules 100*a,b* being adjacently and pivotally connected to create a tire deflating blade system 300. In this embodiment, the shaft 308 of the first module 100*a* is interconnected with the shaft 310 of the second module 100*b* via universal joints, such that the female first connector 302 of the first module 100*a* is joined with the male second connector 304 of the second module 100*b* via a locking pin 306.

In operation as the shaft 308 of the first module 100*a* is moved longitudinally with the shaft 310 of the second module 100*b*, the blades 312*a–c* of the first module 100*a* are moved simultaneously with the blades 314*a–c* of the second module 100*b*, resulting in all the blades 312*a–c*, 314*a–c* simultaneously being in the retracted position or the armed position.

During storage, the blades 312*a–c*, 314*a–c* are placed in the retracted position and the first module 100*a* is disconnected from the second module 100*b* by removing the locking pin 306 and separates the female first connector 302 of the first module 100*a* from the male second connector 304 of the second module 100*b*. The first module 100*a* and second module 100*b* are stored within a storage container for later use. Alternatively, the tire deflating blade system 300 may be embedded permanently within a road surface.

Figure 4A:
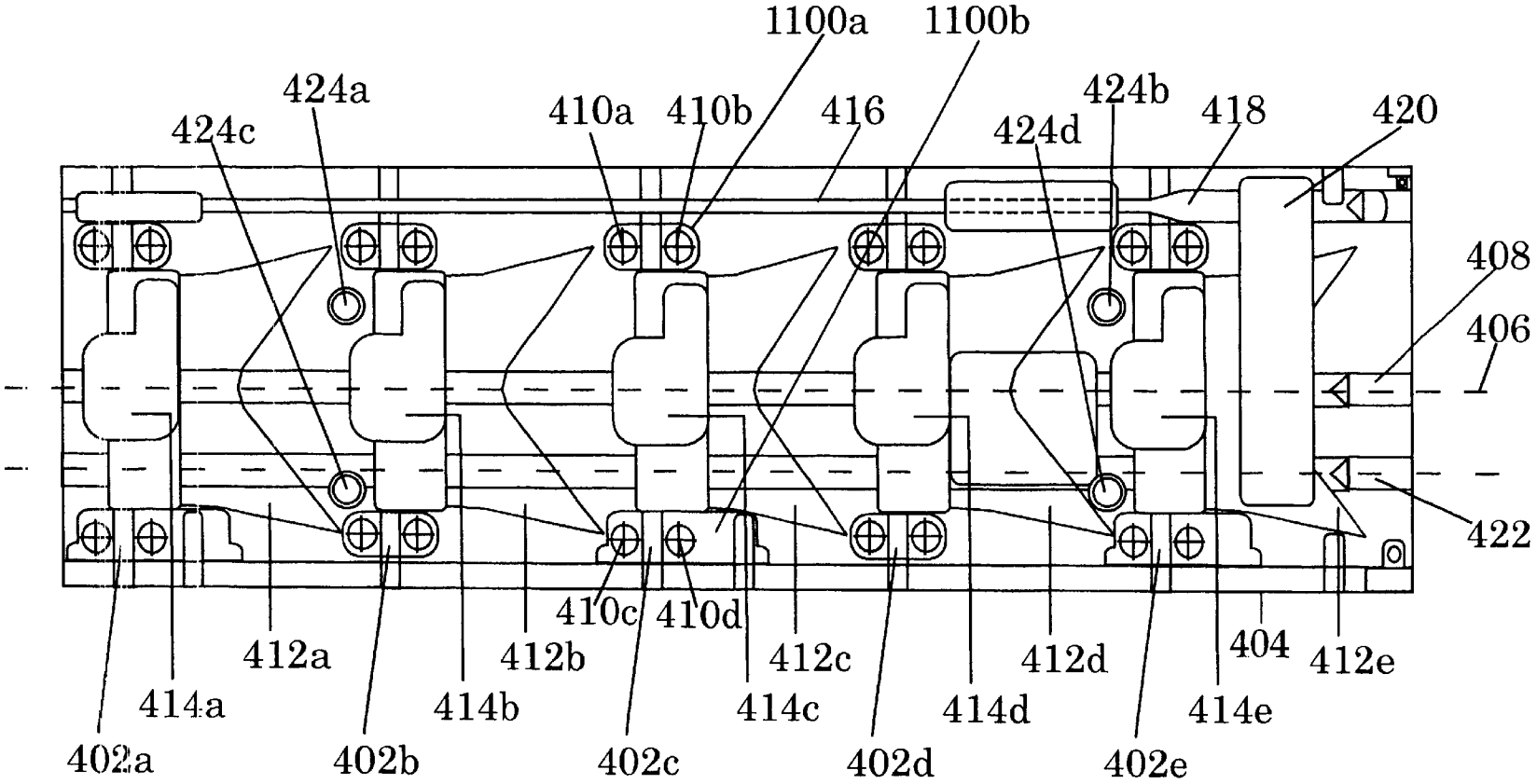
FIG. 4A is a planar top view of a tire deflation blade system module with the blades in a retracted position and having a barber pole.
Figure 4B:
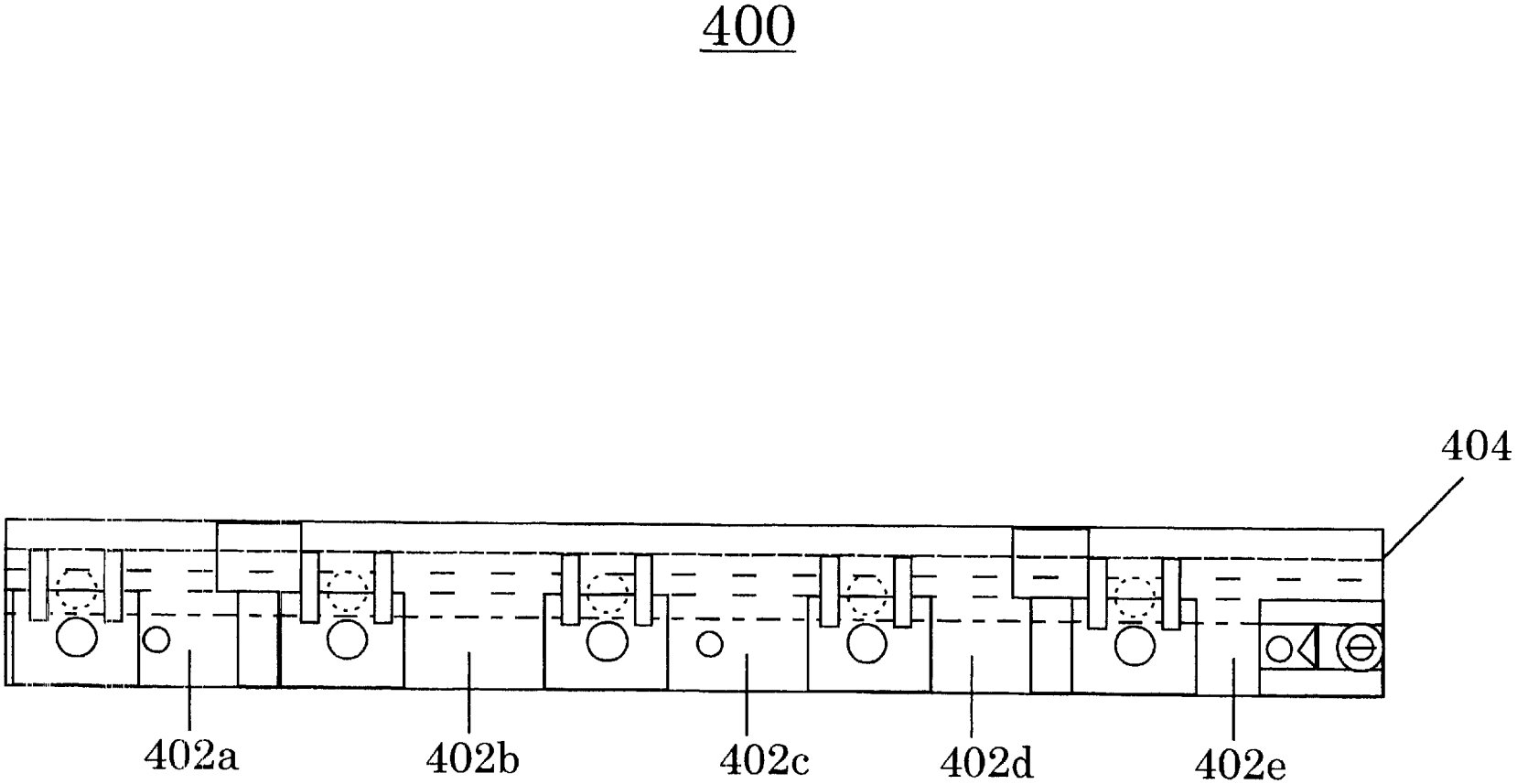
FIG. 4B is a planar side view of the tire deflation blade system module with the blades in a retracted position.
Figure 4C:
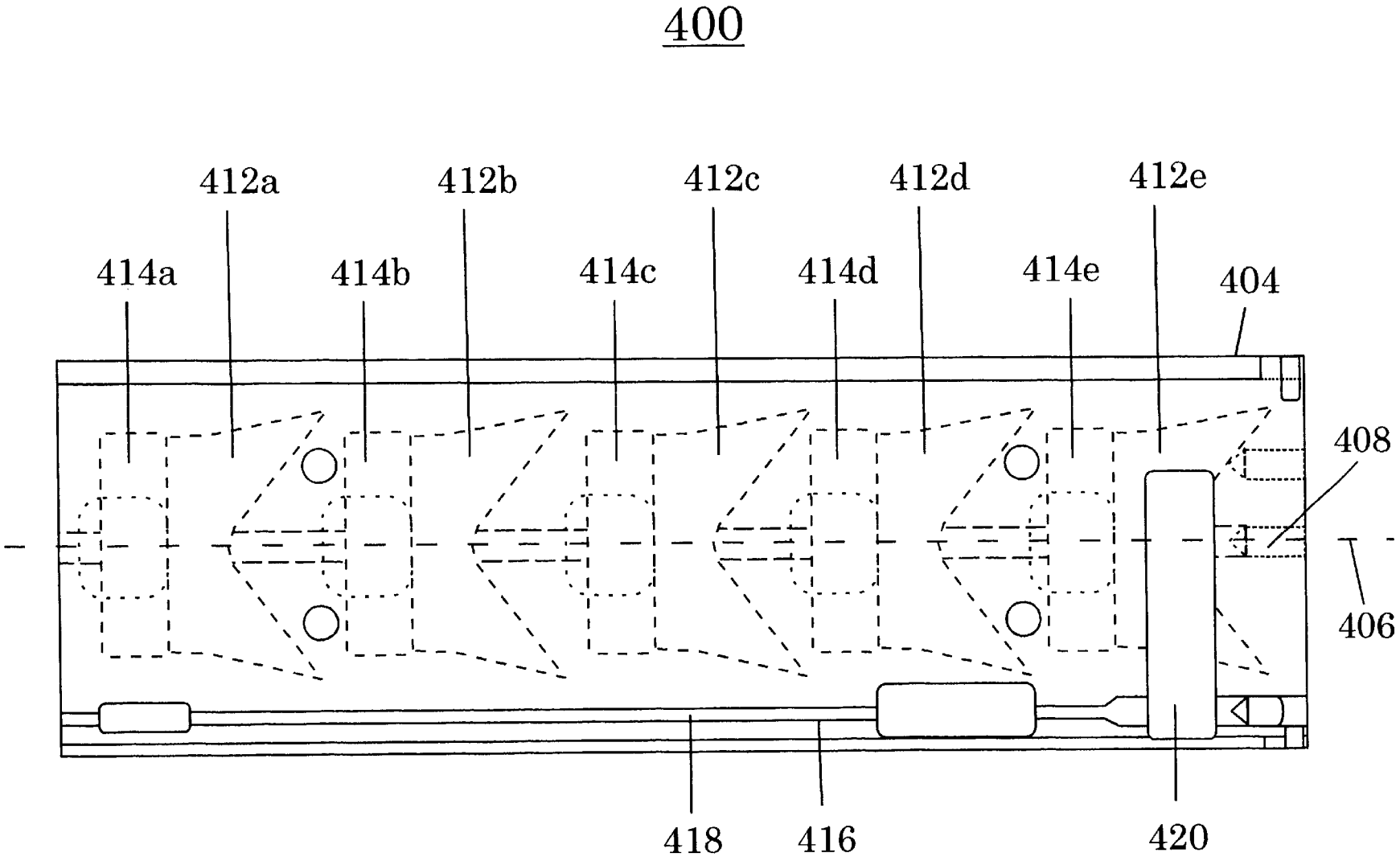
FIG. 4C is a planar bottom view of the tire deflation blade system module with the blades in a retracted position.
Figure 4D:
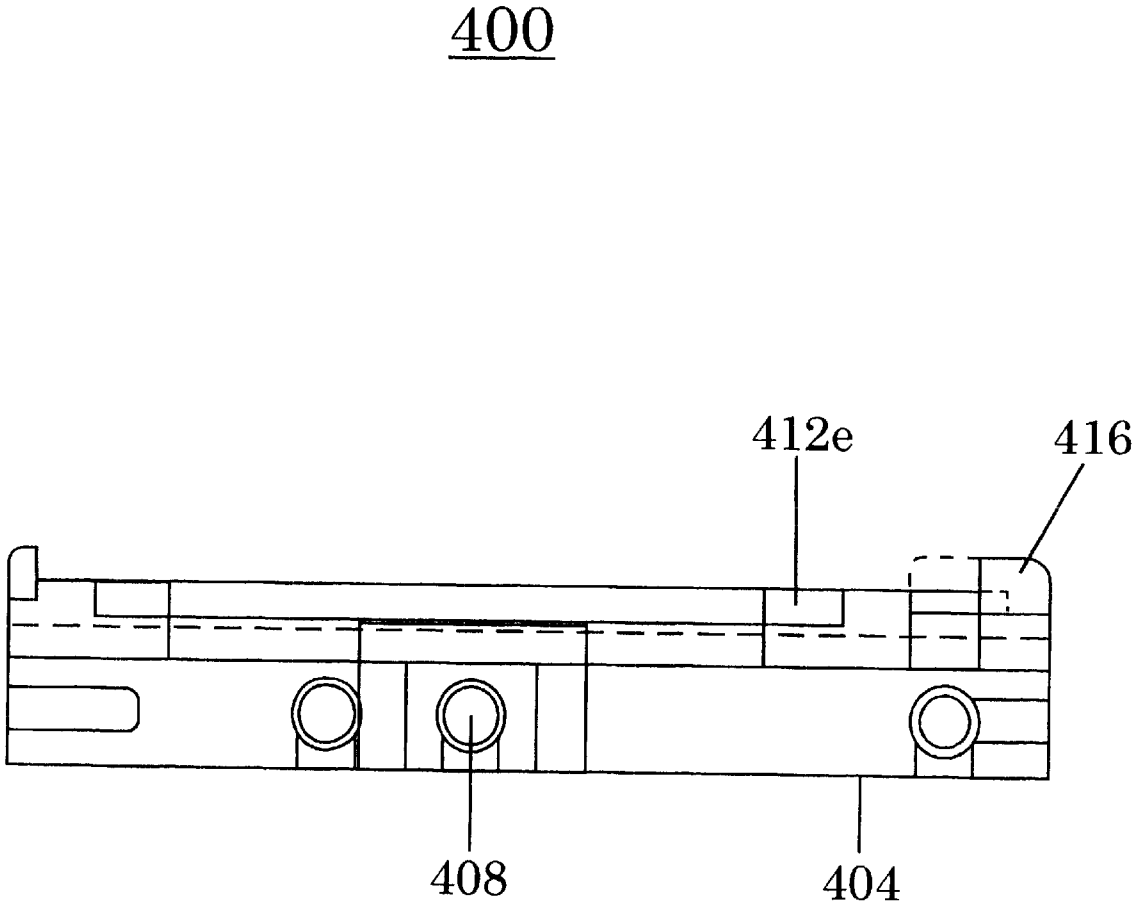
FIG. 4D is a planar end view of the tire deflation blade system module with the blades in a retracted position.

FIGS. 4A–D are more detailed planar views of a tire deflation blade system module ("module") 400 of the present invention, wherein FIG. 4A shows the top view, FIG. 4B shows the side view, FIG. 4C shows the end view, and FIG. 4D shows the bottom view. The module 400 comprises a bottom plate 404, or an alternative base, having a shaft 408 longitudinally disposed therein along a central axis 406. In this embodiment, a plurality of blades 412*a–e* are rigidly and permanently secured to the bottom plate 404, such that the bottom plate 404 is one integral component on which the blades 412*a–e* are assembled and secured.

The bottom plate 404 is a rectangular base 122 which may optionally have the upwardly sloping sides as the above described base 122. The advantage to using a bottom plate 404 is that it can easily be embedded within a road surface such that the top surface of the bottom plate 404 is even with the top of the road surface. It would be readily apparent to one of ordinary skill in the relevant art to embedded a module 400 of the present invention within a road surface.

The preferred means for securing the blades 412*a–e* is described in terms of a single blade 412*c*, but is equally applicable to all blades 412*a–e*. The blade 412*c* is permanently secured to the bottom plate 404 by a pair of pivot clamps 1100*a,b* which hold down the ends of a blade pivot bar 402*c* incorporated onto the bottom of the blade 412*c*. The blade pivot bar 402*c* can freely rotate, or pivot, back and forth within the pivot clamps 1100*a,b*. The pivot claims are preferably screwed to the bottom plate 404 with screws 410*a–d*.

Each blade 412*a–e* is pivotally connected to the shaft 408 via links 414*a–e* using conventional means, e.g., screws, bolts, welding, and other means for connecting. The links 414*a–e* allow the blades 412*a–e* to rotate between an armed and retracted position. When in an armed position, the blades 412*a–e* are "locked" in an upright position to ensure that the blades 412*a–e* remain in the armed position. Operationally, when the shaft 408 is pulled the links 414*a–e* pull the blades 412*a–e* into the armed position wherein the blade pivot bars 402*a–e* rotate within the pivot claims, e.g., pivot clamps 100*a,b*. When the shaft 408 is pushed, the links 414*a–e* push the blades 412*a–e* into the retracted position wherein the blade pivot bars 402*a–e* rotate within the pivot clamps, e.g., pivot clamps 100*a,b*.

Also shown on FIGS. 4A–D is a means for warning oncoming traffic as to the existence and location of the tire deflating blade system module 400. In the preferred embodiment, the means for warning is a barber pole assembly 416. Similar to the blades 412*a–e*, the barber pole assembly 416 is rotatably connected to the shaft 408 such that when the shaft 408 moves the blades 412*a–e* into the armed position, the shaft 408 also rotates a barber pole 418 from a horizontal position into a vertical, upright position. A hold down clamp 420 is optionally installed to hold down the barber pole assembly 416 during storage and transport. The barber pole assembly 416 is described in greater detail below.

In addition to the module 400 being removably placed on a road surface, the module 400 can also be bolted to a road surface via apertures 424*a–d*. A bolt or screw is inserted into these apertures and secured to the road surface, thereby preventing the module 400 from being removed or pushed out of alignment.

The module 400 may also incorporate a second shaft 422 into the bottom plate 404 wherein the second shaft 422 is used to engage a cover plate assembly 800. The cover plate assembly 800 operates in a manner similar to the shaft 408 used to engage the blades 412*a–e* and is described in greater detail below.

Figure 5A:
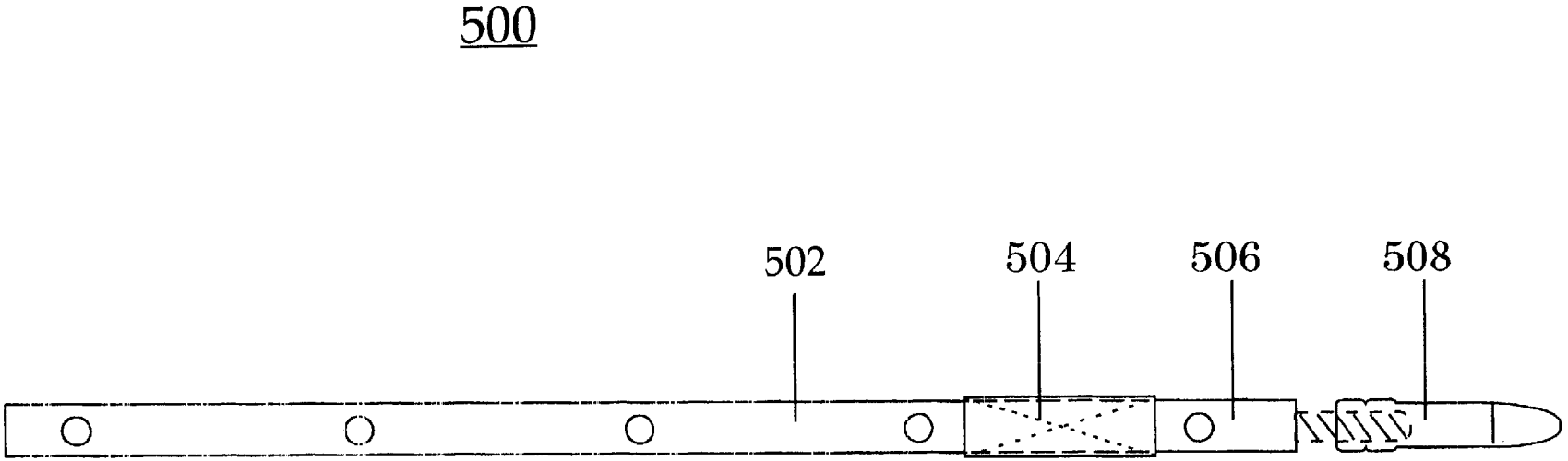
FIG. 5A is a planar side view of a push rod assembly.
Figure 5B:
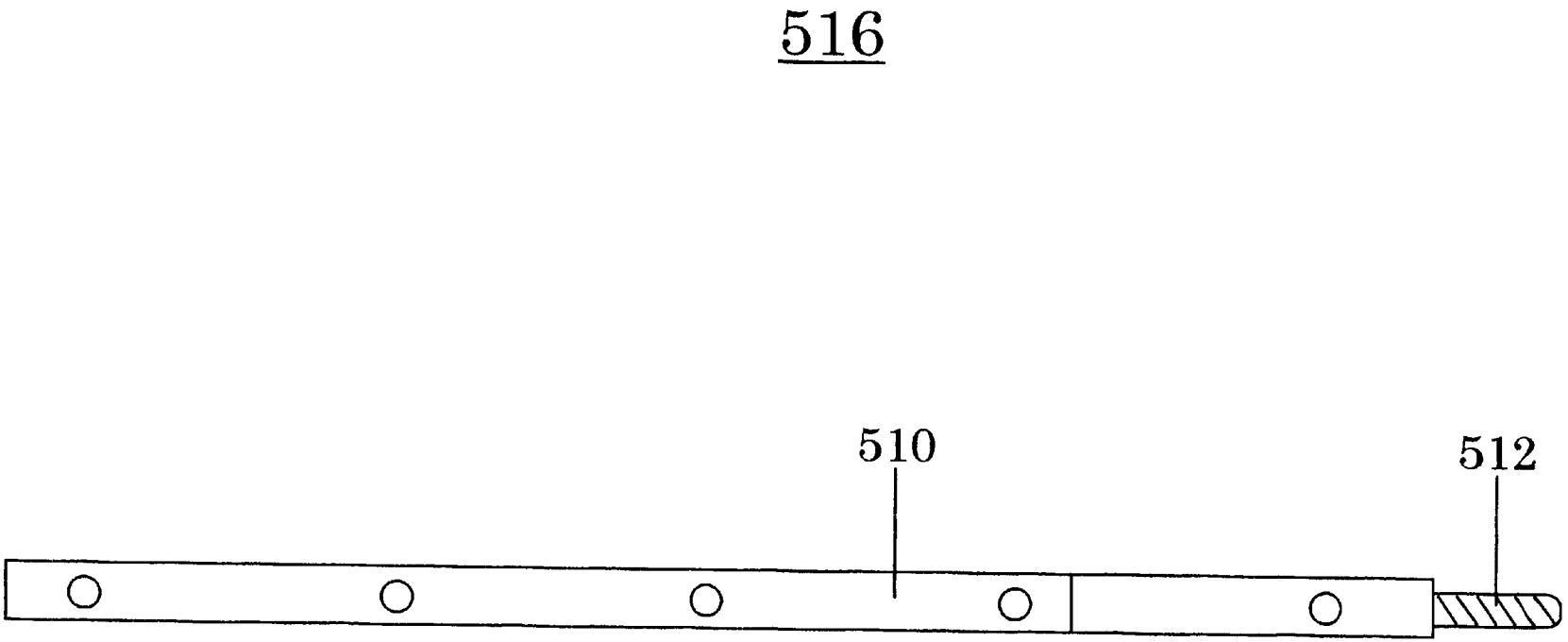
FIG. 5B is a planar side view of an extension shaft.
Figure 5C:
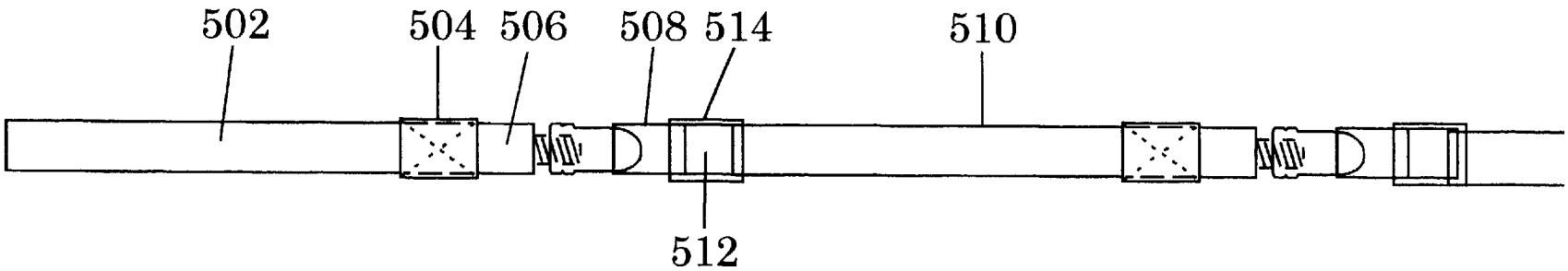
FIG. 5C is a planar side view of multiple interconnected shafts.

FIGS. 5A–C are planar views of a shaft assembly of the present invention, wherein FIG. 5A shows a conventional push rod assembly 500, FIG. 5B shows an extension shaft 516, and FIG. 5C shows an interconnected extension shaft 516 and push rod assembly 500. In this embodiment, the push rod assembly 500 comprises an elongated shaft 502, a handle component 508, and a handle shaft 506 having a first end and a second end, wherein the handle component 508 is attached to the first end of the handle shaft 506 and a spring mechanism 504 is used to connect the elongated shaft 502 with the second end of the handle shaft 506. In operation, when an operator commands the blades 412*a–e* of a tire deflating blade system module 400 into the armed position, the operator moves the handle component 508 in the longitudinal direction, thereby causing the handle shaft 506 to also move longitudinally and engage the spring mechanism 504. The spring mechanism 504 in turn pushes the elongated shaft 502 in a longitudinal direction and holds the elongated shaft 502 in that position. Because the blades 412*a–e* are pivotally connected to the elongated shaft 502, this horizontal movement causes the blades 412*a–e* to rise into the armed position. In reverse, when the operator commands the blades 412*a–e* into the retracted position, the operator once again pushes the handle component 508 in the longitudinal direction. This pushing of the handle component 508 causes the handle shaft 506 to move longitudinally and disengage the spring mechanism 504. Once disengaged, the spring mechanism causes the elongated shaft 502 to move longitudinally and return to its original position, thereby causing the blades 412*a–e* to return to the retracted position.

FIG. 5B is a planar view of an extension shaft 516 being an elongated shaft 510 having two ends wherein one end is a threaded end 512. Therefore, the shafts of two tire deflating blade system modules can be connected by using an extension coupler 514. An extension coupler 514 is an elongated hollow tube with threading on the inside of each end. Therefore, in operation the threaded end 512 of a shaft of a first module is threaded into a first end of the extension coupler 514 and the threaded end 512 of a shaft of a second module is threaded into a second end of the extension coupler 514, thereby joining two modules via their shafts.

A modification of this means for connecting two modules comprises the use of two extension couplers 514 and an extension bar wherein an extension coupler 514 is threaded onto the shaft of two different modules, then the extension bar is used to connect these two extension couplers 514.

In this embodiment, the push rod assembly 500 is used in conjunction with the shafts 408 of multiple modules 400 and with any number of extension shafts 516 and extension couplers 514 as needed to create a tire deflating blade system of a variable length.

Figure 6A:
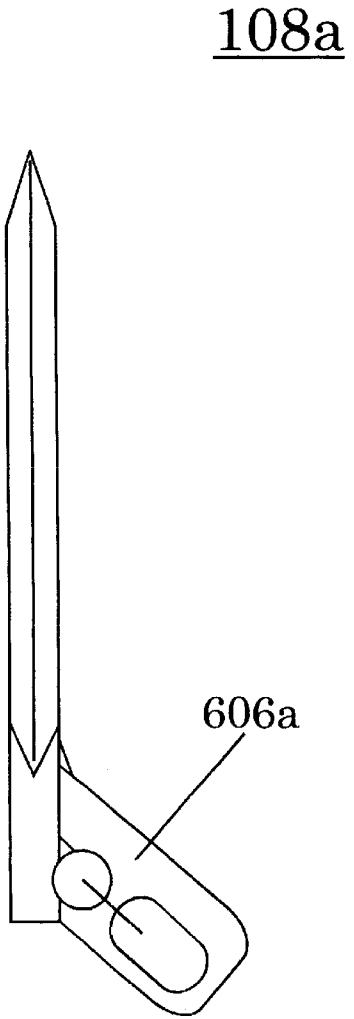
FIG. 6A is a planar side view of a blade.
Figure 6B:
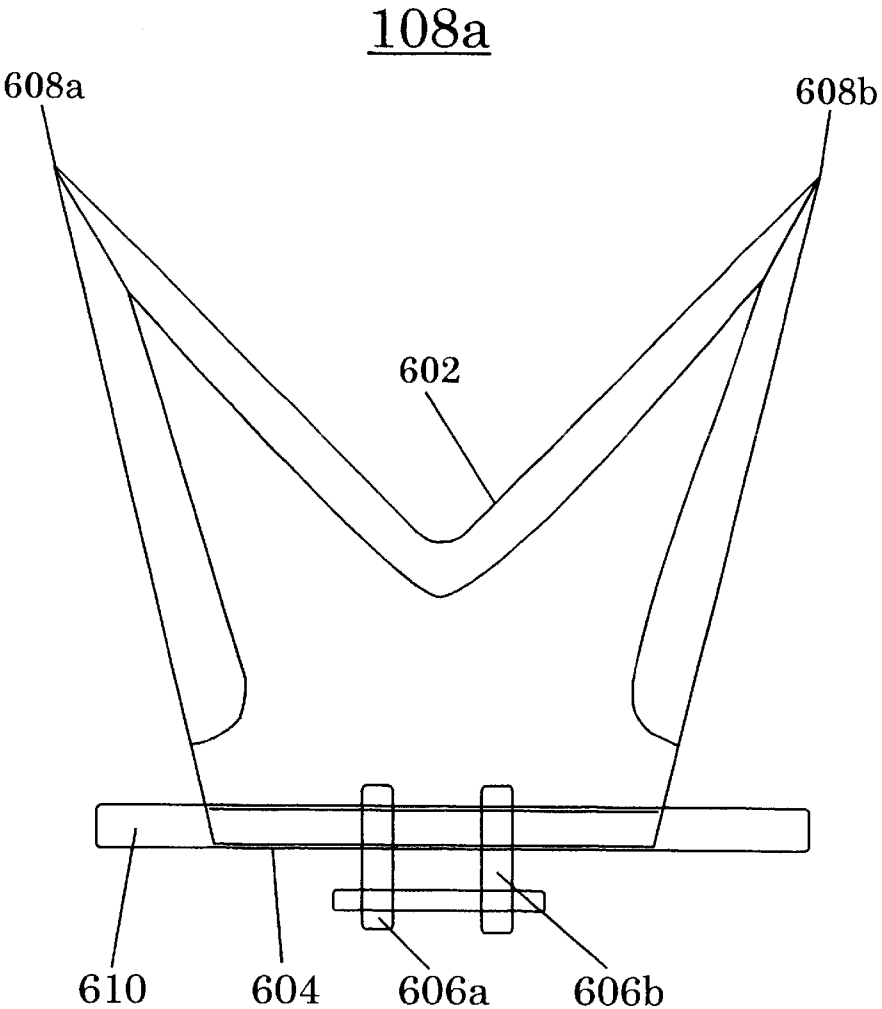
FIG. 6B is a planar front view of the blade.

FIGS. 6A–B are planar views of a blade 108*a* of the present invention. In the preferred embodiment, the blade 108*a* is notched-V design 602 having at least two sharpened edges and at least two sharp points 608*a,b* that are about 3–5 inches apart with the preferred distance being about 4 inches apart. The blade 108*a* is permanently and pivotally secured to the base 122 via the blade pivot bar 610. In the preferred embodiment, two pivot clamps 1100 secure the ends of the blade pivot bar 610 to the base 122 wherein the blade pivot bar 610 can freely rotate within the pivot clamps 610. The blade 108*a* is pivotally connected to the shaft 110 via one or more hinges 606*a,b*. Therefore, as the shaft 110 is moved in the longitudinal direction, the blade 108*a* rotates between an armed and retracted position.

Figure 7A:
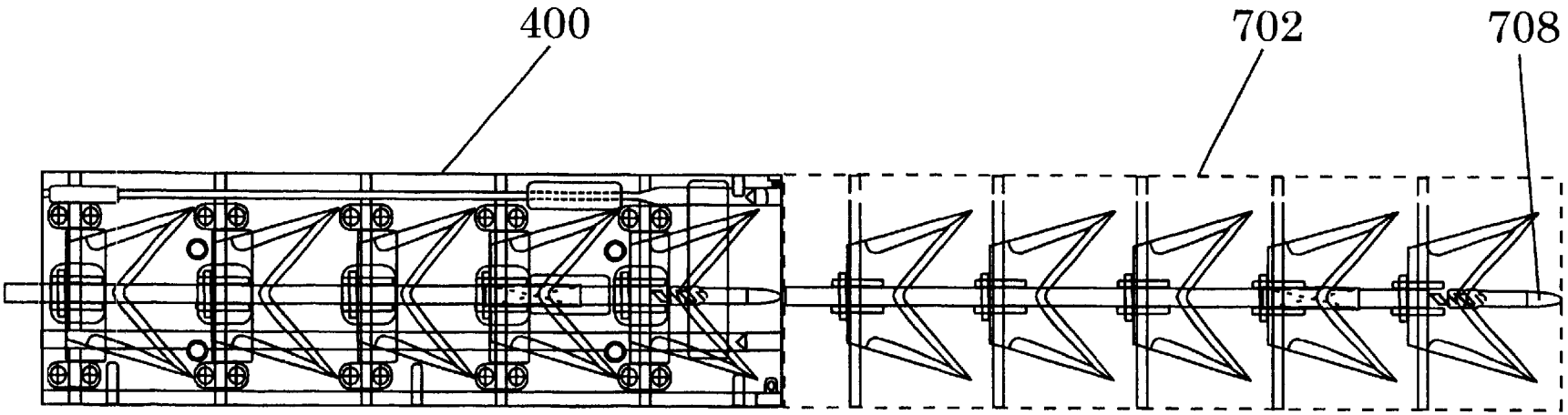
FIG. 7A is a planar top view of a tire deflating blade system of the present invention.
Figure 7B:
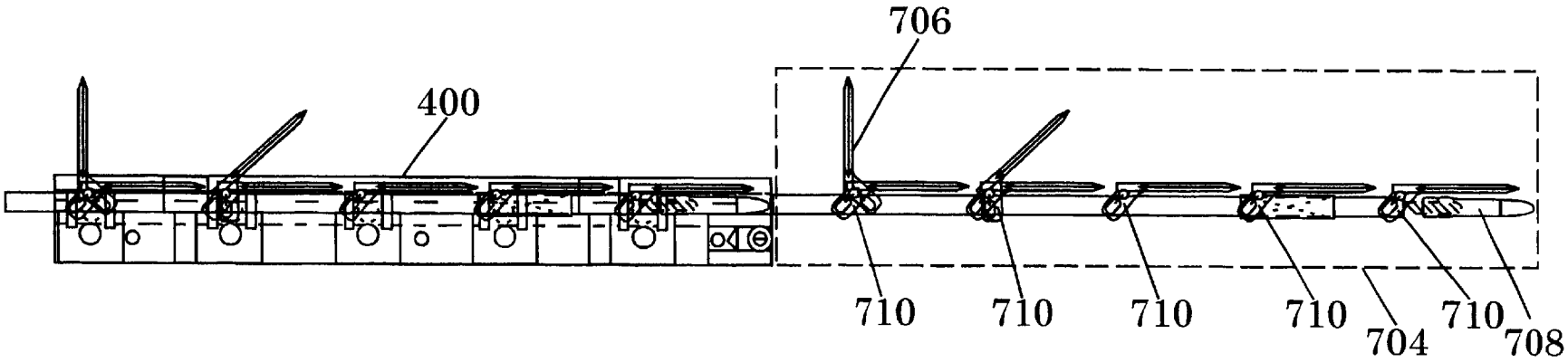
FIG. 7B is a planar side view of the tire deflating blade system showing the rotation of blades between a retracted position and an armed position

FIGS. 7A,B show a planar top and side view of a tire deflating blade system module 400 of the present invention wherein in box 704 a blade 706 is shown moving from the armed position to the retracted position. As the shaft 708 is moved longitudinally, the pivot arm 710 is also moved in a longitudinal direction. As the pivot arm 710 is pulled in a first direction, the blade 706 is pulled into an armed position. As the pivot arm 710 is pushed back in the second direction, the blade 706 is pushed down into its retracted position. The use of pivot arms 710 is well known in the relevant arts.

Figure 8A:
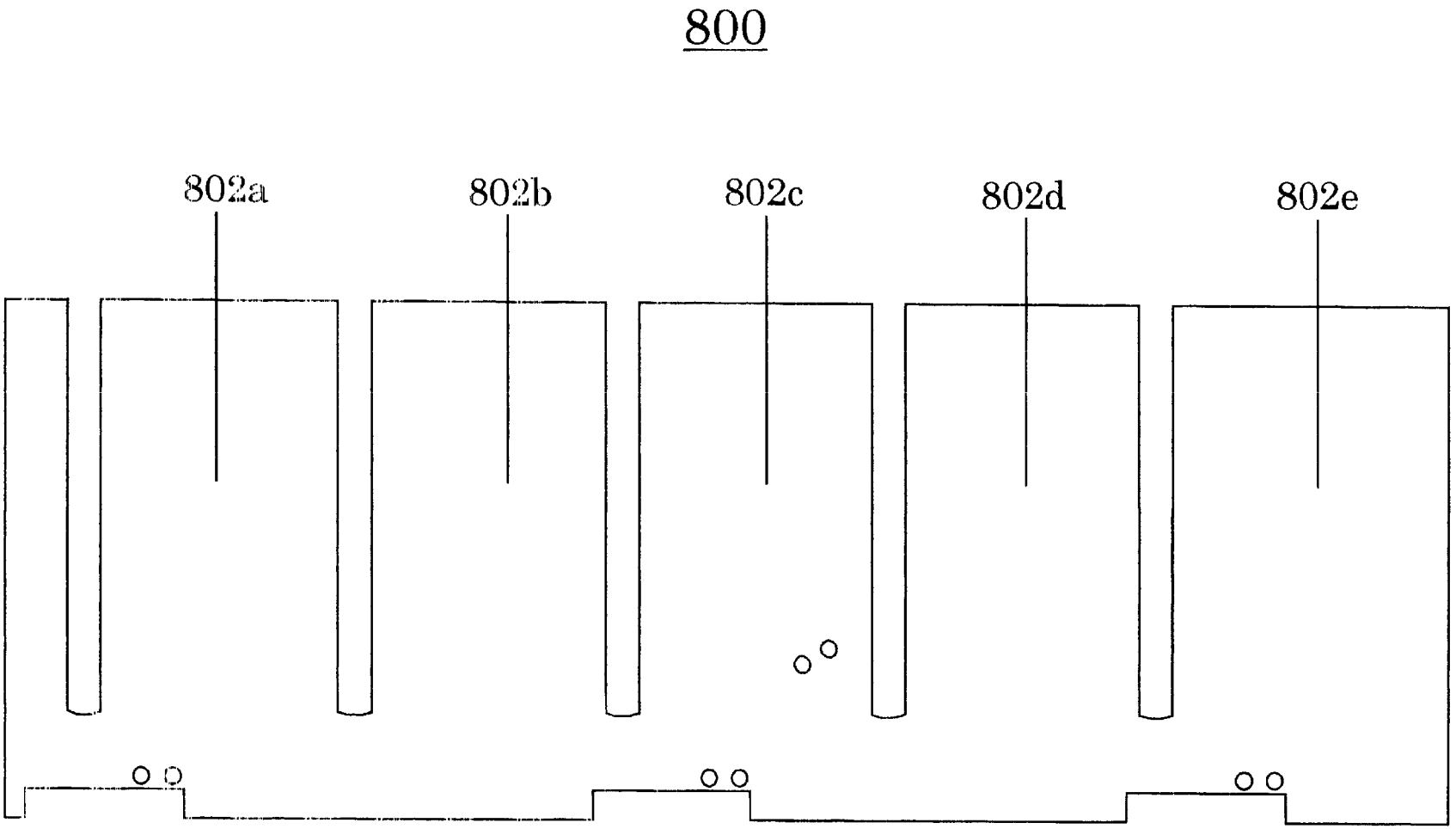
FIG. 8A is a planar top view of a cover plate assembly.
Figure 8B:
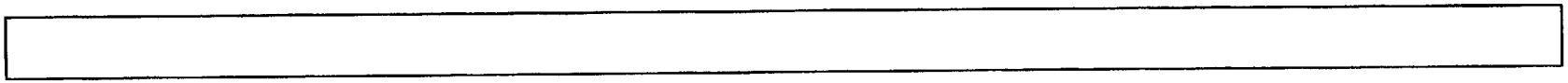
FIG. 8B is a planar side view of the cover plate assembly.
Figure 8C:
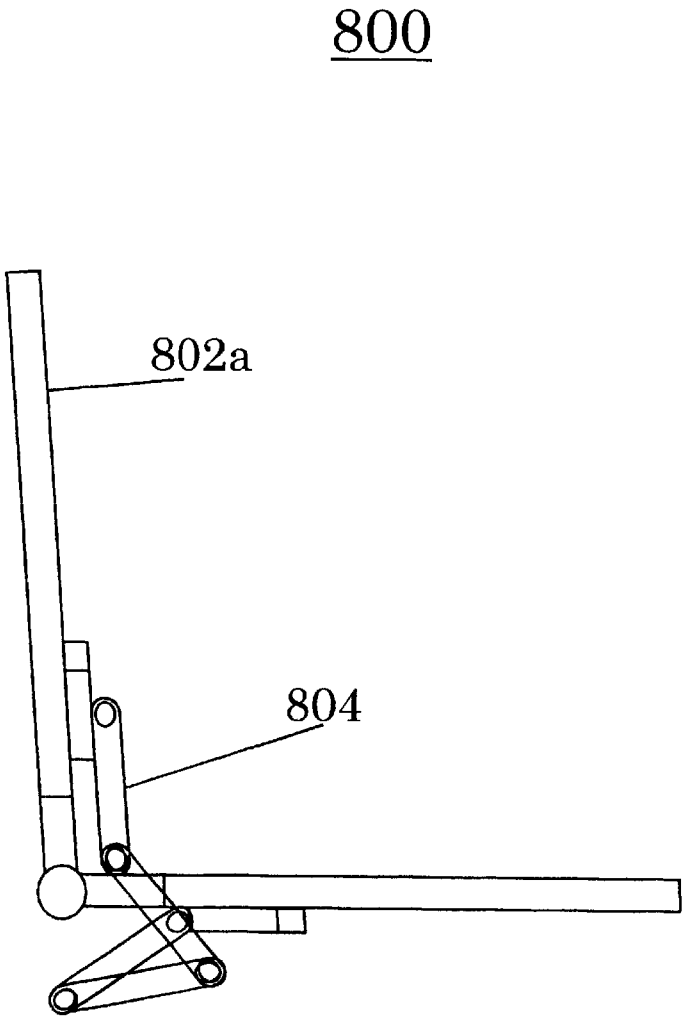
FIG. 8C is a planar side view of a cover plate rotated to an upright position.

FIGS. 8A,B shows the optional cover plate assembly 800 of the present invention. Cover plates 802*a–e* are used to cover the blades 412*a–e* of a module 400 when the blades 412*a–e* are in the retracted position. They are used to protect the blades 412*a–e* when not in use, as well as to protect persons from getting hurt on the blades 412*a–e*. In the preferred embodiment, there is one cover plate 802*a–e* for each blade 412*a–e*. Operationally, the cover plates 800 are attached to the shaft 408 of a module 400 by the same means as the blades 412*a–e*; that is, by a hinge assembly 804. Therefore, when engaged, the cover plates 802*a–e* rotate open allowing the blades 412*a–e* to be in the armed position. The use of a cover plate assembly 800 is optional.

Figure 9A:
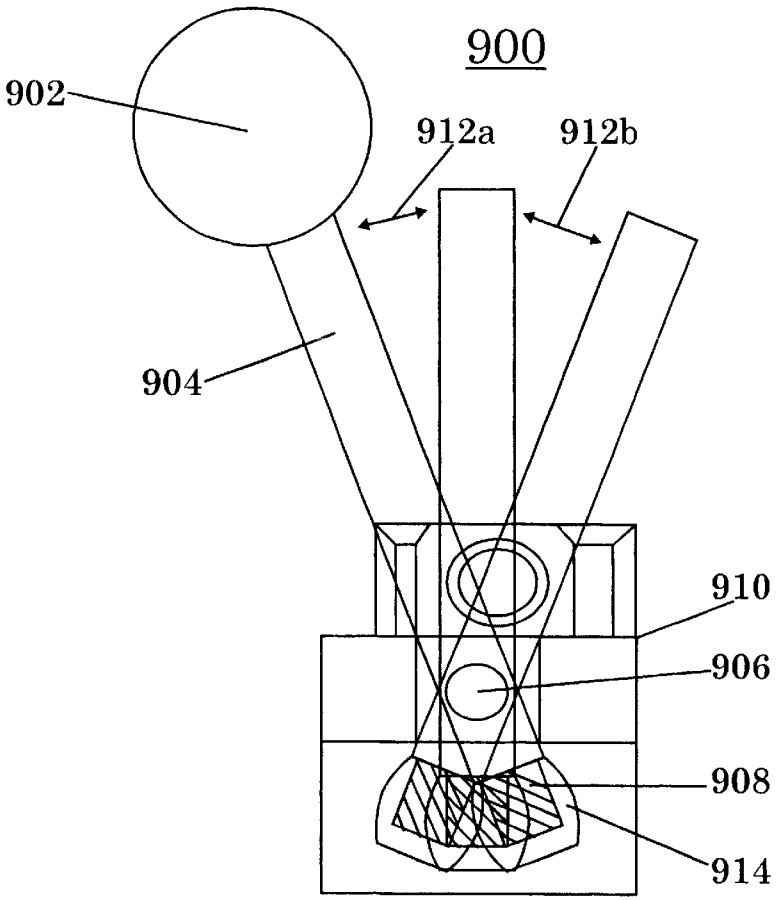
FIG. 9A is a planar side view of a lever assembly of the present invention in operation.
Figure 9B:
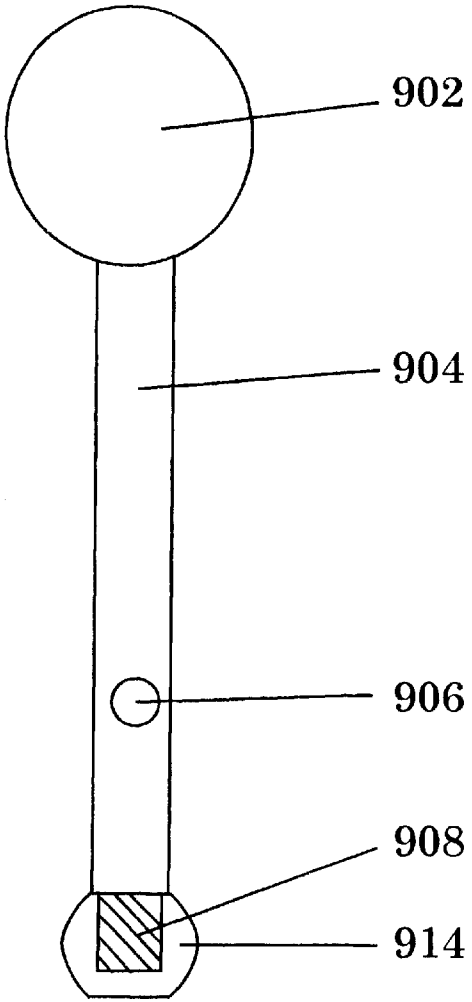
FIG. 9B is a planar side view of the lever.

FIGS. 9A,B shows the side view of the lever assembly 900 of the present invention, which is one mechanical means for pushing/pulling 912*a,b* the shaft 110 of a tire deflating blade system module 100, thereby rotating the blades 108*a–c* between an armed and retracted position. The lever assembly 900 comprises a handle 902 secured to the top end of a lever 904. The lever 904 is pivotally secured to a lever stabilizer 910 by a means for pivoting 906, e.g., a conventional pin. The lever 904 terminates at an end component 914 which may be screwed on to the threaded bottom end 908 of the lever 904. When the lever assembly 900 is pushed/pulled 912*a,b*, this action moves the shaft 110 in a longitudinal direction according to conventional methods, thereby moving the blades 108*a,c* attached to the shaft 110 as described above. It would be readily apparent for one of ordinary skill in the relevant art to manufacture and use a lever assembly 900 as described herein.

Figure 12A:
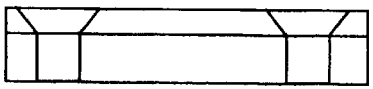
FIG. 12A is a planar side view of a hinge of the present invention.
Figure 12B:
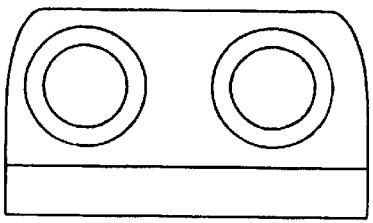
FIG. 12B is a planar top view of the hinge.
Figure 11A:
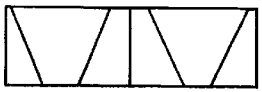
FIG. 11A is a planar side view of a pivot clamp of the present invention.
Figure 11B:
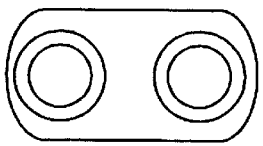
FIG. 11B is a planar top view of the pivot clamp.
Figure 10A:
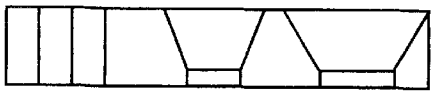
FIG. 10A is a planar side view of a link of the present invention.
Figure 10B:
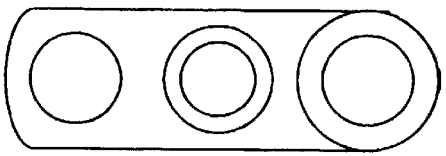
FIG. 10B is a planar top view of the link.
Figure 13A:
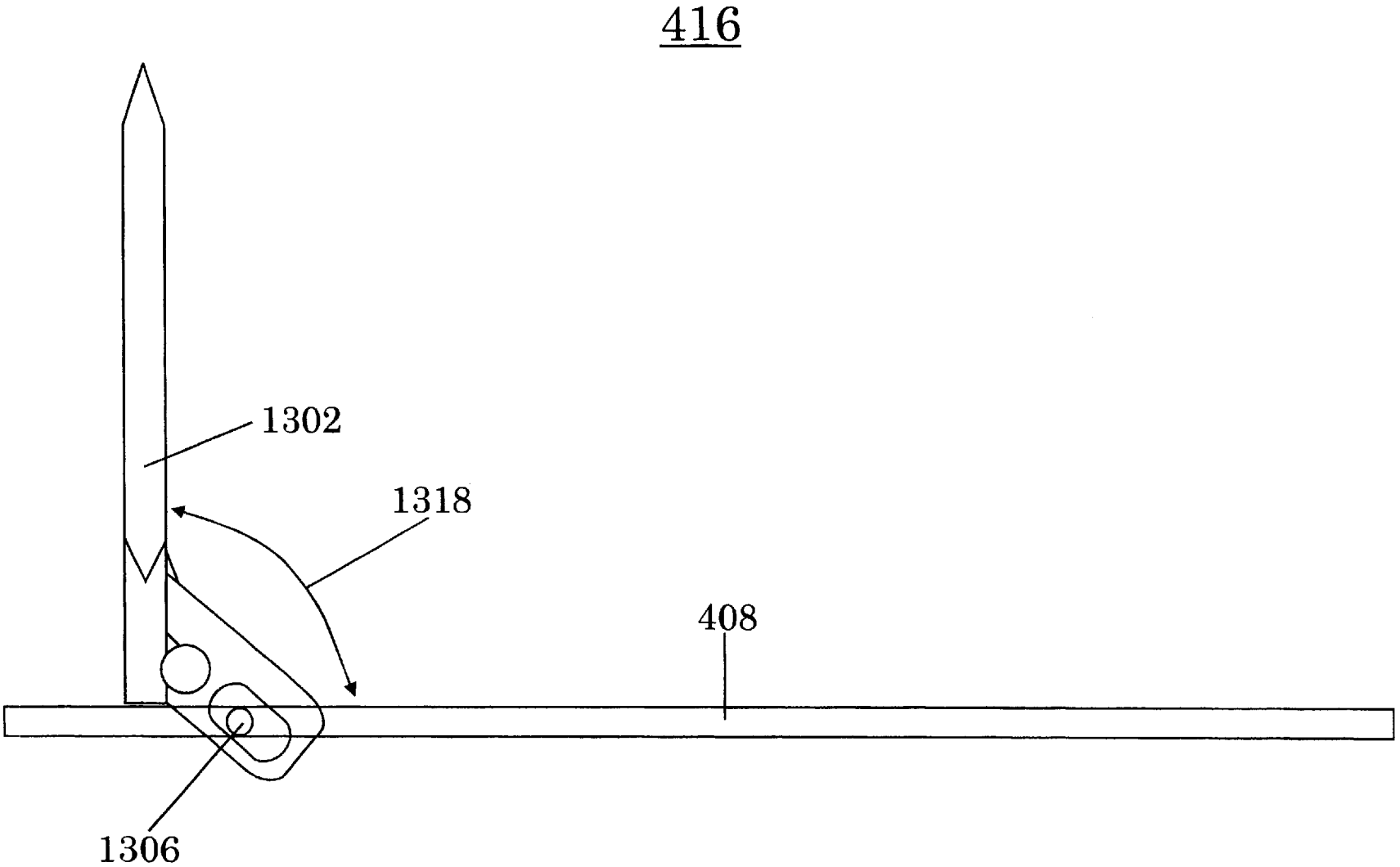
FIG. 13A is a planar side view of a barber pole assembly.
Figure 13B:
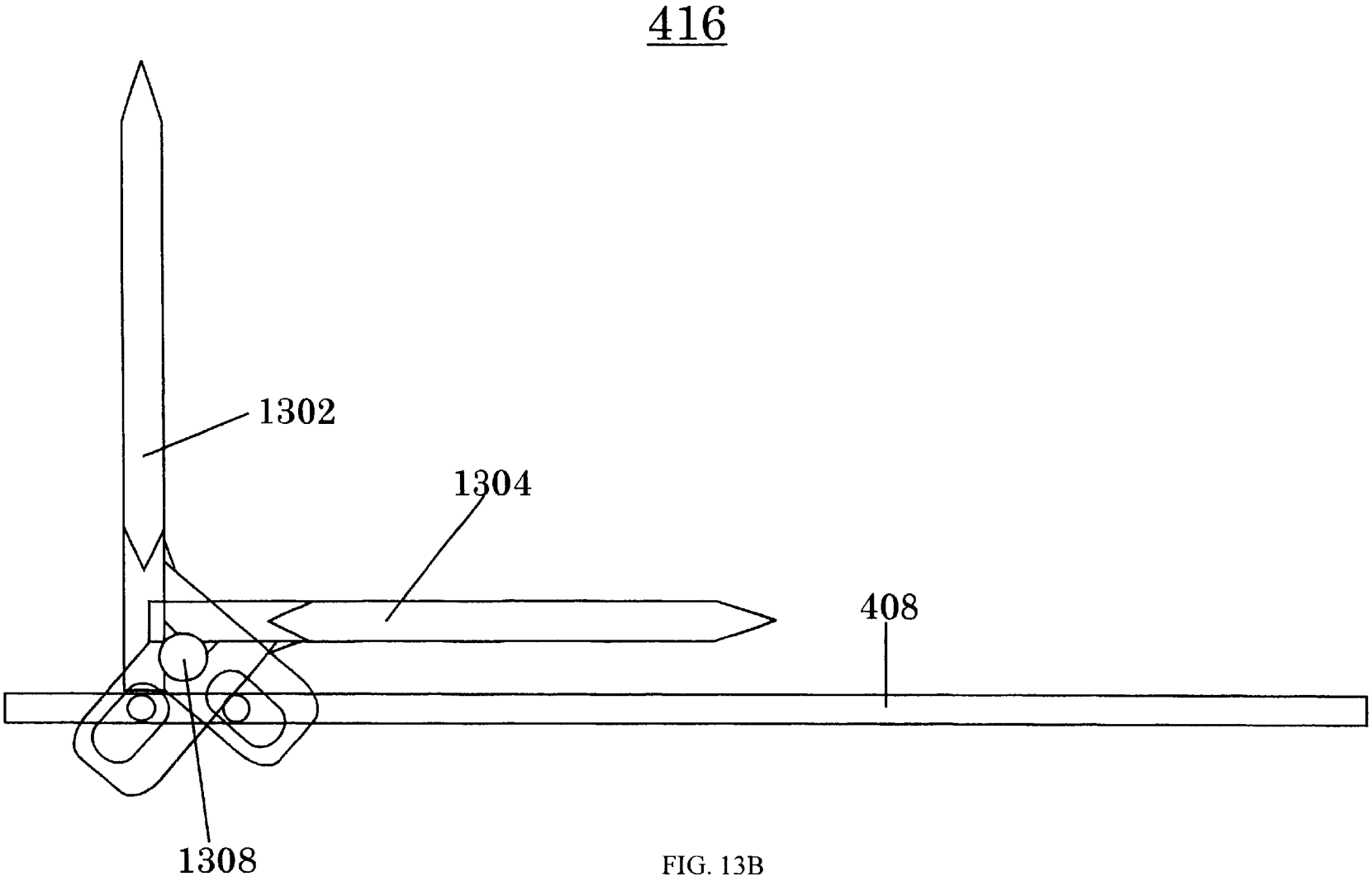
FIG. 13B is a planar side view of an alternative barber pole assembly.
Figure 14:
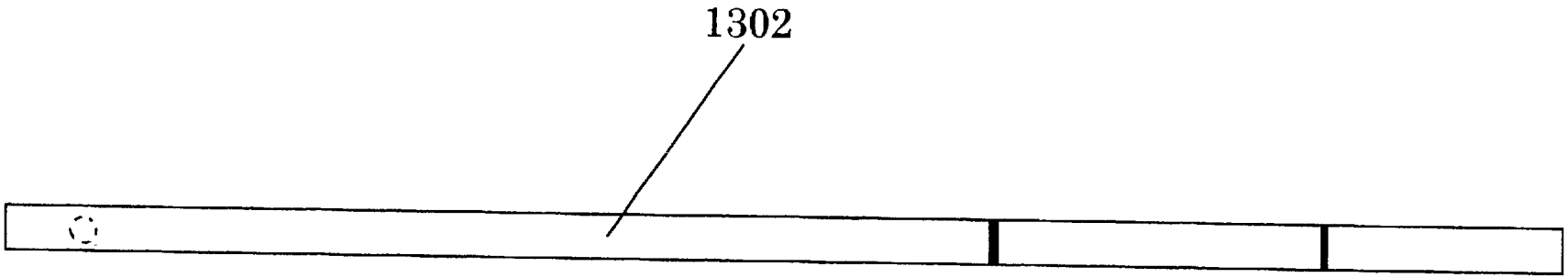
FIG. 14 is a barber pole push rod.
Figure 15A:
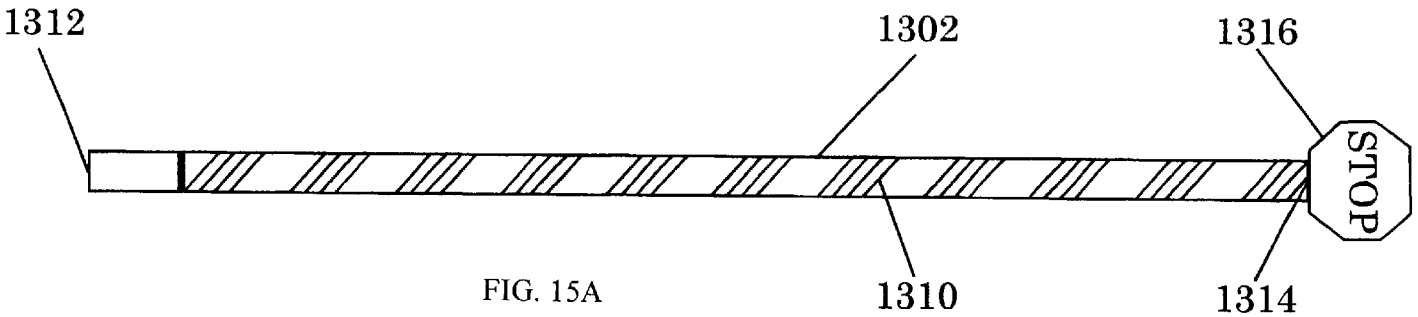
FIG. 15A is a planar side view of a barber pole.
Figure 15B:
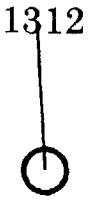
FIG. 15B is a planar end view of the barber pole.
Figure 17B:
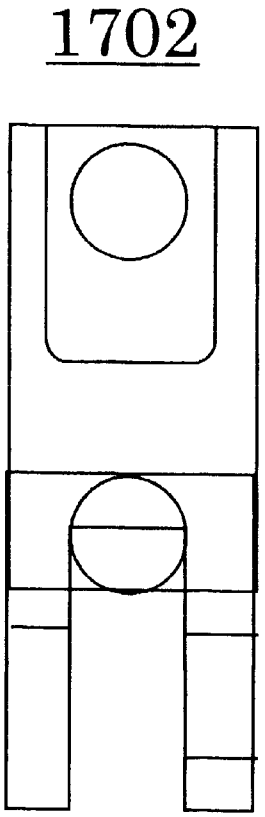
FIG. 17B is a planar front view of the barber poll pivot arm.
Figure 17A:
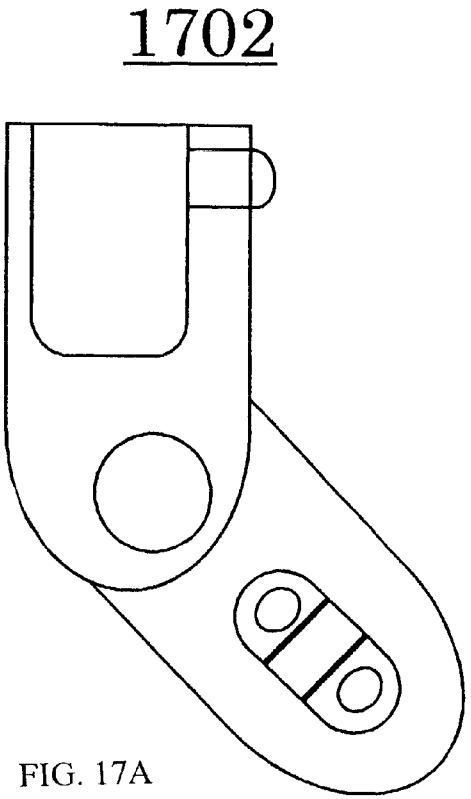
FIG. 17A is a planar side view of a barber poll pivot arm.

FIGS. 10–12 shows the top and side views of three different types of brackets used with the present invention in component assembly: a link 1000, pivot clamp 1100, and hinge 1200. The holes in the brackets are recessed in order to accommodate the head of bolts and/or screws.

The remaining figures illustrate the barber pole assembly 416 of the present invention. The barber pole assembly 416 is an optional means for warning oncoming vehicles of the deployed blade system. In the preferred embodiment, the barber pole assembly 416 is "stop-sign" like warning sign 1316 secured to the top end 1314 of a barber pole 1302. The barber pole 1302 is rotatably attached to the shaft 110 of a module 100 using a barber poll pivot arm 1302 resulting in the barber pole 1302 being attached to the shaft 110 in the same manner as the blades 108*a–c*. Therefore, when engaging the shaft 110, the pole 1302 is rotated to a vertical, or up, position 1318 via the barber poll pivot arm. 1302 and the sign 1316 on top thereof is visible to oncoming vehicles. In the preferred embodiment, the pole 1302 is about 18 inches long. In an alternative embodiment, a first barber pole 1302 and a second barber pole 1304 are connected to the shaft 110 by a dual barber poll pivot arm 1308. This embodiment allows either the first barber pole 1302 or the second barber pole 1304 to be raised according to the direction that the shaft 110 is moved. Therefore, when moved in a first direction, the shaft 10 causes the first barber pole 1302 to be raised and the second barber pole 1304 to be lowered, and when moved in a second direction, the shaft 110 causes the first barber pole 1302 to be lowered and the second barber pole 1304 to be raised.

Also shown are commercially available spring washers 1602, 1604 which are used in conjunction with a barber poll pivot arm 1702. The barber poll pivot arm 1702 operates in a manner similar to the pivot arms 606 used by the blades 108*a–c*. In the preferred embodiment, the barber pole 1302 is covered with yellow/black tape 1310 to enhance its warning capabilities. Any comparable means for rotatably connecting the barber pole 1302 to the shaft 110 can be used.

All dimensions and component described herein are for convenience purposes only. It would be readily apparent for one of ordinary skill in the relevant arts to design and manufacture a tire deflation blade system module 100 of the present invention having comparable features and dimensions, and manufactured using comparable materials.

CONCLUSION

While various embodiments of the present invention have been described above, it should be understood that they have been presented by the way of example only, and not limitation. It will be understood by those skilled in the art that various changes in form and details may be made therein without departing from the spirit and scope of the invention as defined in the specification and the appended claims. Thus, the breadth and scope of the present invention should not be limited by any of the above-described exemplary embodiments, but should be defined in accordance with the specification and any equivalents.

What is claimed is:

1. A tire deflating blade system module, comprising:

a base having a top surface;

a shaft longitudinally disposed within said base and having a length;

two or more blades pivotally connected to said shaft wherein said two or more blades are positioned along the length of said shaft such that two adjacent said blades are separate by a predefined distance, each said blade having a plurality of sharpened edges and one or more sharp points; and a means for engaging said blades into an armed position and into a retracted position, wherein said means for engaging moves said shaft along a longitudinal axis within said base such that when said shaft moves in a first longitudinal direction, said blades are moved into said armed position, and when said shaft moves in a second longitudinal direction, said blades are moved into said retracted position.

2. The tire deflating blade system module according to claim 1, wherein each said blade is a notched-V design.

3. The tire deflating blade system module according to claim 1, wherein said base further comprises a plurality of apertures recessed within said base such that each said blade fits within one said aperture when in the retracted position.

4. The tire deflating blade system module according to claim 3, further comprising a cover plate assembly for covering said plurality of apertures in said base, a means for raising said cover plate assembly when said blades are in said armed position, and a means for lowering said cover plate assembly when said blades are in said retracted position such that when said blades are in said retracted position, said cover plate assembly is in contact with the top surface of said base and covers said plurality of apertures to prevent exposure of said blades.

5. The tire deflating blade system module according to claim 4, wherein said cover plate assembly comprises a plurality of cover plates, wherein each said cover plate covers one said aperture containing one said blade, and said means for raising and said means for lowering said cover plate assembly is said cover plate assembly being pivotally connected to said shaft.

6. The tire deflating blade system module according to claim 3, wherein said apertures have the shape of said blades.

7. The tire deflating blade system module according to claim 1, wherein said base comprises a means for securing said base to a road surface.

8. The tire deflating blade system module according to claim 1, wherein said shaft comprises a means for connecting to a second shaft of a second tire deflating blade system module.

9. The tire deflating blade system module according to claim 8, wherein said means for connecting comprises said shaft having a first end and a second end, a first connector secured to said first end of said shaft, and a second connector secured to said second end of said shaft, wherein said first connector interconnects with a second connector secured to a second end of said second shaft of said second tire deflating blade system module.

10. The tire deflating blade system module according to claim 9, wherein said first connector is a female universal joint and said second connectors are male universal joints.

11. The tire deflating blade system module according to claim 9, wherein said first connector and said second connector are threaded ends of said shaft, and said means for connecting further comprises an extension coupler being a hollow tube with a first end and a second end wherein said first end and said second end are threaded such that said first connector of said shaft of said first tire deflating blade system module is threaded into said first end of said extension coupler and said second connector of said shaft of said second tire deflating blade system module is threaded into said second end of said extension coupler.

12. The tire deflating blade system module according to claim 1, wherein said means for engaging said blades into an armed position and into a retracted position comprises a push rod assembly.

13. The tire deflating blade module according to claim 1, further comprising a means for warning oncoming traffic as to the existence and location of the tire deflating blade module, said means for warning being pivotally connected to said shaft such that when said shaft moves in said first longitudinal direction, said means for warning displays a warning to oncoming vehicles, and when said shaft moves in said second longitudinal direction, said means for warning removes said warning from oncoming vehicles.

14. The tire deflating blade module according to claim 13, wherein said means for warning is a barber pole having a top end and a bottom end, and a means for pivotally connecting said bottom end of said barber pole to said shaft such that when said means for engaging said blades moves said blades into said armed position, said means for engaging rotates said barber pole into an upright position and when said means for engaging said blades moves said blades into said retracted position, said means for engaging rotates said barber pole into a retracted position.

15. The tire deflating blade module according to claim 14, wherein a warning sign is rigidly attached to said top end of said barber pole.

16. The tire deflating blade module according to claim 14, wherein said barber pole is covered with a warning pattern.

17. The tire deflating blade module according to claim 13, wherein said means for warning further comprises a barber pole having a top end and a bottom end, and a means for pivotally connecting said bottom end of said barber pole to said shaft such that when said means for engaging said blades moves said blades into said armed position, said means for engaging rotates said barber pole into a retracted position and when said means for engaging said blades moves said blades into said retracted position, said means for engaging rotates said barber pole into an upright position.

18. The tire deflating blade system module according to claim 1, wherein said base comprises a bottom plate.

19. The tire deflating blade system module according to claim 18, wherein said base is generally rectangular in shape.

20. The tire deflating blade system module according to claim 18, wherein said base further comprises a first side having an upwardly sloping angle, a second side having an upwardly sloping angle and a top portion connecting said first side and said second side such that the end profile of said base is generally trapezoidal in shape.

* * * * *